United States Patent [19]

MacKinnon, Jr. et al.

[11] 4,455,794

[45] Jun. 26, 1984

[54] INSULATED WALL SYSTEM AND METHOD OF CONSTRUCTION

[76] Inventors: Donald J. MacKinnon, Jr., 1109 Main St., Cotuit, Mass. 02635; Richard P. Crowley, 152 Ice Valley Rd., Osterville, Mass. 02655

[21] Appl. No.: 376,294

[22] Filed: May 10, 1982

[51] Int. Cl.[3] ..... E04B 1/60

[52] U.S. Cl. ..... 52/98; 52/410; 52/464; 52/741; 52/512; 220/445; 220/449; 29/413; 29/513

[58] Field of Search ..... 52/98–100, 52/361, 735, 712–716, 741, 406, 410, 509, 512, 459–465; 220/445, 449, 452, DIG. 9, 1 M; 428/132; 29/513, 413, 414

[56] References Cited

U.S. PATENT DOCUMENTS

| | | | |
|---|---|---|---|
| 255,087 | 3/1882 | Sagendorph | 52/459 |
| 384,118 | 6/1888 | Bellinger | 29/513 |
| 526,022 | 9/1894 | Carey | 428/132 |
| 979,628 | 12/1910 | Wright et al. | 52/370 |
| 1,251,830 | 1/1918 | Siegfried | 220/445 |
| 2,014,035 | 9/1935 | Attwood | 52/461 |
| 2,074,055 | 3/1937 | Irwin | 52/406 |
| 2,865,058 | 12/1958 | Andersson et al. | 52/746 |
| 3,378,975 | 4/1968 | Hill | 52/509 |
| 3,561,180 | 2/1971 | Wise | 52/735 |

*Primary Examiner*—James L. Ridgill, Jr.
*Attorney, Agent, or Firm*—Richard P. Crowley

[57] ABSTRACT

An insulated wall system and method of construction, which system comprises: generally horizontal metal strapping bands secured to a wall, the metal strapping bands characterized by lines of weakness therein adapted to form tab portions from the metal strapping bands; a solid-panel insulating material placed against the wall and secured by a tab portion of the generally horizontal metal strapping bands, the tab portion extending about one edge of the panel material and against the interior side thereof, so as to secure the panel material against the wall; a generally vertical, metal-bank strapping material secured to the interior tab portion; and wallboard or finished wall material secured to the generally vertical metal-band material, thereby providing for an insulated wall system and method of construction employing solid panel material, without the requirement of wall studs.

15 Claims, 6 Drawing Figures

INSULATED WALL SYSTEM AND METHOD OF CONSTRUCTION

BACKGROUND OF THE INVENTION

Typically, in the construction of an insulated wall, wooden or metal studs are placed in a spaced-apart relationship to form a series of vertical studs with cavities therebetween. Insulating material, such as roll-type fiberglass material, is secured in the wall cavity between the studs, and, thereafter, wallboard or finished wall materials are secured to the outside of the studs, to form the finished wall system. While effective, such a prior-art system requires the positioning, securing and using of wall studs, with the use of soft or flexible insulation, and means to secure the insulation in position within the wall cavities formed, and in general requires considerable labor, material and expense.

SUMMARY OF THE INVENTION

The invention relates to an improved insulated-wall construction system and method of constructing the insulated wall. In particular, the invention concerns an insulated wall system employing metal strapping material and rigid or semirigid insulating material, without the need or requirement of prior wall studs.

The invention comprises an insulated wall system which employs the use of generally horizontal, metal strapping band material characterized by a line of weakness therein, whereby tab portions may be formed from the metal strapping band by the installer with a high degree of ease such as by the use of snips or pliers. The metal strapping bands having lines of weakness are generally secured horizontally against a substrate surface, such as a wall surface and more particularly a concrete wall surface, such as in the cellar of a residence. Generally, a plurality of the metal strapping bands are employed; for example, two, three or four, and are placed generally parallel to each other across the substrate wall and secured thereto, such as, for example, by screws or nails. A panel-type insulating material, more particularly a foam insulating material, such as solid or rigid polystyrene foam or polyurethane foam material of the desired thickness, e.g., 1–3", is then vertically placed against the substrate containing the metal strapping bands.

The panel-type insulating material is secured in place and in vertical sequence with abutting edges along the substrate wall surface, by removing a small tab portion of the metal strapping band along the line of weakness. The tab portion having a rectangular or other shape is removed, such as by pliers or metal snips, and is bent around the one edge of the panel material and to the interior side of the panel material. The tab portion at the one or each level of the strapping band then secures the panel material is position vertically against the substrate wall. The tab portion has a length sufficient to be formed about the edge of the panel material, e.g., 1–12", and to extend a short distance, e.g., 1–3", against and across the interior wall of the panel.

Regular metal or wood strapping bands are then disposed vertically along the edge of the panel material and against the tab portion which extends across the interior wall surface of the panel material. Desirably, the vertically extending metal-strapping-band material extends somewhat outwardly from the outer edge of the panel material, so that the next adjoining panel material may be retained at that edge within a cavity formed by the extending metal-strapping band material. The metal-strapping band material is then secured, such as by a screw or by adhesive, to the extending tab portion against the interior wall surface of the panel material.

Thus, the insulating panel materials may be placed easily against each other and extend around the substrate surface in a continuous manner in a close edge abutting manner for insulation purposes merely by bending the respective tab portion of the generally horizontal metal strapping materials to retain the panel material in position. The outer end of the tab portion is then used to secure the generally vertical metal strapping bands to the interior wall surface of the panel material. Thereafter, the interior wall may be covered through the use of wallboard or other semifinished or finished wall panel interior material, wherein the interior panels may be screwed or otherwise secured, such as by adhesives, as desired directly to the vertically extending strapping material.

The insulated wall system as described and the method of preparing the wall system provide significant advantages over the prior-art systems, in that it permits the saving of labor and material and, therefore, is inexpensive to install and is particularly useful, where it is desired to employ semirigid or rigid panel-type foam insulation materials. The invention avoids the necessity of using separately positioned wood or metal wall studs and provides the advantage of providing a high insulating efficiency of the styrene and urethane, in comparison to fiberglass, while avoiding the problems of retaining the fiberglass within wall cavities.

The invention will be described for the purpose of illustration only in connection with a particular embodiment, however, it is recognized that those persons skilled in the art may make various changes and modifications in the embodiment, all falling within the spirit and scope of the invention.

DESCRIPTION OF THE EMBODIMENTS

Figure 1:
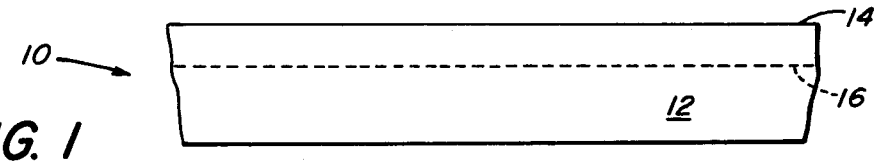
FIG. 1 is a plan illustration of a horizontal strapping band material characterized by lines of weakness therein.

FIG. 1 shows metal strapping band material 10, such as of 20, 24 or 26 metal gauge, with the body of the strapping material 12 having a line of weakness 16 by such a perforation or scoring therein extending generally parallel to edge 14, or otherwise having a line of weakness therein, in order to permit the formation of a tab portion of the material from either edge of the band 12. For the purpose of simplicity, the formation of a rectangular elongated tab portion from the one edge is preferred.

Figure 2:
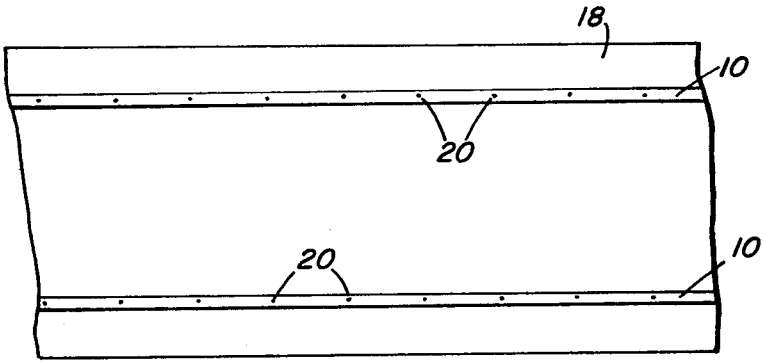
FIG. 2 is a schematic illustration of the band material of FIG. 1 secured against a substrate wall.

FIG. 2 shows the material 10 secured generally parallel and horizontally against a concrete wall or other wall substrate 18 and secured to the wall such as by metal screws 20.

Figure 3:
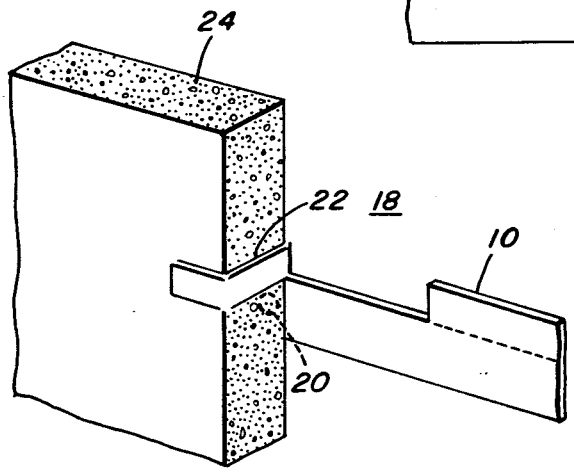
FIG. 3 is a schematic illustration of an insulating panel material retained in position against the substrate wall of FIG. 2.

FIG. 3 shows an insulating panel material 24 of polystyrene or polyurethane insulation such as of 1 to 6 inches thickness and 12 to 30 inches in width, placed against the substrate wall 18. A tap portion 22 cut or removed from the band 12 has been bent over the one edge of the insulating material 24, so that the tab portion extends across the edge width and for a short distance adjacent the interior wall surface of the panel 24. The tab portion is easily formed by the installer through the use of tin snips or pliers, through cutting inwardly into the band material 12 to reach the line of weakness and, thereafter, bending the tab portion 22 from the band 12. Screws 20 should be placed just inward of the edge of the material 24 and under the beginning of tab 22 to provide support for the outward bending of the tab 24.

Figure 4:
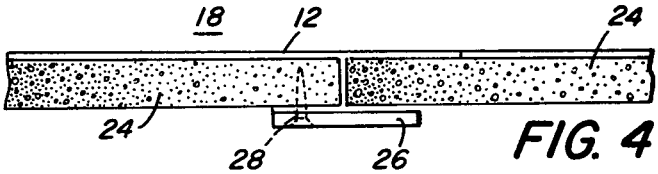
FIG. 4 is a cross-sectional view of FIG. 3 with vertical band material in place.

FIG. 4 is a cross-sectional view of FIG. 3 which also shows the employment of a generally vertical strapping band 26, particularly of metal, which has been placed against the interior wall portion of the tab 22, the metal vertical band 26 is secured vertically in position through the use of a metal screw 28 into the extended portion of the tab on the interior wall of the panel. As illustrated, the metal band material 26 preferably extends somewhat beyond the edge of the panel 24, e.g., ½ to 1½, in order to provide a cavity or retaining recess for the installation of the next panel as shown.

Figure 5:
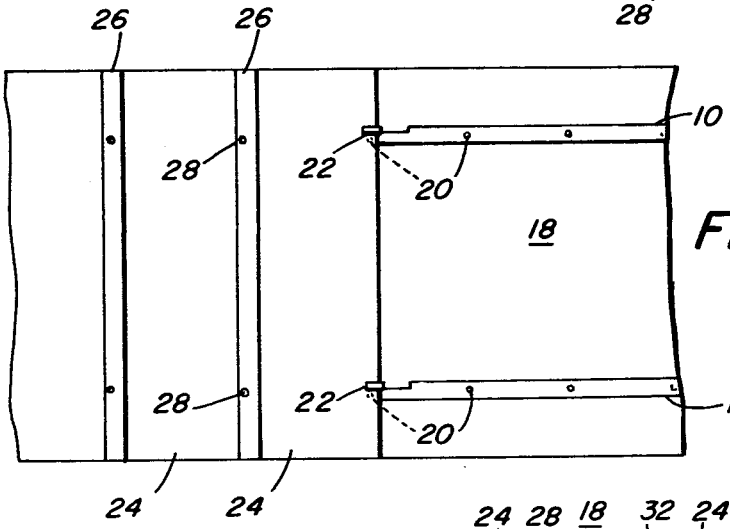
FIG. 5 is a plan illustration of the substrate wall partially covered with insulating panel material with vertical band material in place.

FIG. 5 shows a partially finished insulated wall system showing the facing, wherein two panels have been secured, as in FIG. 4, and showing the tab portions 22 holding the upper and lower edges of one insulating panel 24 in position, while the other edge is held in the recess formed by the extension of the vertical band 26.

Figure 6:
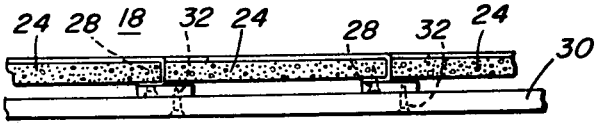
FIG. 6 is a cross-sectional view of the insulated finished wall system of the invention.

FIG. 6 is a cross-sectional view showing the insulation against the vertical band 26 of a wallboard, wherein the wallboard or other finished or semifinished wall panel 30 is secured in the upright position through metal screws, nails or adhesive 32 secured at any position along and to the generally vertical and parallel bands 26.

The horizontal metal scrapping band material has been shown having a single parallel line of weakness therein whereby the installer may cut easily into the line of weakness and then strip or pull a tab portion of predetermined width and desired length from the band. It is recognized that the tab portion may be preformed and be of various shapes and may be removed from the center of the band without resort to edge cutting. Also, it is recognized that the wall system and method may be carried out without the lines of weakness with the tab portion preformed or precut or simply cut by the installer in its entirety.

As thus shown and illustrated, an insulated wall system is constructed, without the need for the use of prior art studs, and which provides for the use of a semirigid insulating panel material, particularly of polymeric foam panel material. The insulated wall system so constructed and designed provides for significant savings in labor and material.

What is claimed is:

1. An insulated wall system which comprises in combination:

(a) a solid, generally vertical, wall substrate;

(b) at least one first metal-strapping-band material secured to and extending generally horizontally across the substrate, the strapping-band-material having or adapted to provide tab portions therefrom;

(c) means to secure the first strapping-band material to the substrate;

(d) an insulating, self-supporting, panel material placed against the first strapping band, the panel material held in position against the substrate by a tab portion from the first strapping-band material extending over the one edge of the panel material and extending over a short distance onto the interior wall surface of the panel material;

(e) generally vertical, second strapping-band material placed against and extending over the tab portion on the interior wall surface of the panel material and extending generally outwardly and over the outer edge of the panel material retained in position by the tab, so as to form a generally vertical recess for the insertion of the edge of the next panel material therein;

(f) means to secure the generally vertical, second strapping-band material to that portion of the tab material on the interior wall surface of the panel; and (g) interior wall-panel material secured to the generally vertical second strapping-band material and means to so secure the wall-panel material thereto, whereby an insulated wall system is formed, wherein a substrate is covered by insulation and by an interior wall surface.

2. The system of claim 1 wherein the solid, vertical, wall substrate comprises a concrete-wall substrate.

3. The system of claim 1 wherein the first metal strapping band is characterized by a general line of weakness extending inwardly from one edge and generally parallel thereto and extending along the strapping-band material, whereby the installer may form a tab portion, by cutting inwardly to the line of weakness and then bending the tab portion of desired length along the line of weakness over the one edge of the panel material.

4. The system of claim 1 wherein the panel material comprises an insulating, semirigid foam panel material.

5. The system of claim 1 wherein the wall-panel material secured to the generally vertical, second strapping band material comprises wallboard, and wherein the wallboard is secured to the generally vertical second strapping band material through the use of metal screws.

6. The system of claim 1 which comprises a plurality of generally horizontal, spaced apart, parallel first metal-strapping-band materials and a plurality of generally vertical, spaced apart, parallel second metal-strapping-band materials, and a plurality of interior wall panel-type materials, to form a generally insulated wall system.

7. The system of claim 1 wherein the tab portion comprises a generally rectangular tab generally greater than ½ inch in width and from 2 to 12 inches in length, the tab portion extending across the interior wall surface of the panel material being about 1 inch or greater.

8. The system of claim 1 wherein the first metal-strapping-band material is characterized by a line of weakness therein which defines at least a portion of the tab portion to be employed.

9. The system of claim 1 wherein the generally vertical second strapping-band material extends beyond the outer edge of the panel material, a distance of about ½ to 1½ inches.

10. An insulated wall system which comprises in combination:

(a) a generally vertical, wall substrate;

(b) a plurality of horizontal metal-strapping-band material secured to the substrate and extending generally horizontally across the substrate, the horizontal metal-strapping-band material spaced apart and generally parallel and having a tab portion thereon or adapted to provide tab portions therefrom;

(c) means to secure the horizontal, strapping-band material to the substrate;

(d) an insulating, self-supporting panel material placed against the horizontal strapping-band material secured to the substrate, the panel material held in position against the substrate by tab portions from each of the horizontal strapping-band material adjacent the one edge of the panel material, the tab portion extending over one edge of the panel material, the tab portion extending over one edge of the panel material and extending over a short distance onto the interior wall surface of the panel material;

(e) generally vertical, metal-strapping-band material placed against and extending over the tab portions on the interior wall surface of the panel material, the generally vertical strapping-band material extending generally outwardly over the outer edge of the panel material retained in position by the tab, so as to form a generally vertical recess of ½ to about 1½ inches for the insertion of the edge of the next panel material therein;

(f) means to secure the generally vertical strapping-band material to the portion of the tabs on the interior wall surface of the panel material; and (g) interior wall panel materials secured to the generally vertical strapping-band materials, so as to provide a plurality of tab-recess retained panel materials with a plurality of generally vertical, metal-strapping-band materials and a plurality of interior wall panel materials, thereby forming an insulated wall system wherein the substrate is covered by a plurality of insulation panels and an interior wall surface.

11. A method of constructing an insulated wall, which method comprises:

(a) securing at least one metal strapping band to a substrate, the strapping band generally extending horizontally thereacross and parallel to the floor;

(b) placing a first insulating panel material against the substrate and against the metal strapping band;

(c) forming a tab portion from the horizontal metal strapping band and bending the tab portion against and over the one edge of the panel-type material, so that at least a portion of said tab portion extends against the interior wall surface of the panel material to retain the panel material in position against the substrate;

(d) placing a generally vertical, metal-strapping-band material against the interior wall surface of the panel material and securing the generally vertical strapping band material to that portion of the tab on the interior wall surface of the panel, such that the vertical strapping-band material extends outwardly over the outer edge of the panel material to form a vertical recess for the insertion of the next panel material;

(e) placing additional panel materials against each other in the respective recess in an edge-to-edge relationship and retaining each of the said panel material through the bending of the tab portion against one edge thereof;

(f) securing generally vertical, strapping-band material to each tab portion of each secured panel; and, (g) securing an interior wall section to the generally vertical, strapping-band material, thereby forming an insulated wall system, without the employment of studs.

12. The method of claim 10 which includes cutting inwardly into the generally horizontal band material to a line of weakness and, thereafter, removing a tab portion along the line of weakness.

13. The method of claim 12 which includes placing one edge of the next succeeding panel into the recess formed by the extending vertical strapping band material, and securing the opposite edge in place by a tab portion being bent from the generally horizontal strapping band material.

14. The method of claim 12 wherein the tab portion is generally rectangular in shape and is removed by cutting inwardly into one outer edge of the metal-strapping-band material.

15. The method of claim 12 wherein the panel material comprises a semirigid insulating foam generally rectangular panel material.

* * * * *